United States Patent [19]

Lulay

[11] 4,244,173

[45] Jan. 13, 1981

[54] BOUCLÉ YARN AND PROCESS FOR ITS PREPARATION

[75] Inventor: Arthur Lulay, Wilmington, Del.

[73] Assignee: E. I. Du Pont de Nemours and Company, Wilmington, Del.

[21] Appl. No.: 951,395

[22] Filed: Oct. 16, 1978

[51] Int. Cl.[3] ..... D02G 1/18; D02G 3/24; D02G 3/42

[52] U.S. Cl. ..... 57/227; 28/156; 28/281; 57/12; 57/208; 57/254; 57/351; 57/905

[58] Field of Search ..... 57/351, 210, 225, 211, 57/254, 224, 255, 226, 905, 227, 12, 6, 206–208; 28/156, 281

[56] References Cited

U.S. PATENT DOCUMENTS

| | | | |
|---|---|---|---|
| 2,201,759 | 5/1940 | Bry | 57/207 |
| 2,849,785 | 9/1958 | McCullough et al. | 57/207 X |
| 2,864,230 | 12/1958 | Moore, Jr. | 57/6 |
| 3,279,163 | 10/1966 | Lulay et al. | 57/254 |
| 3,353,345 | 11/1967 | Setzer | 57/255 |
| 3,380,244 | 4/1968 | Martin | 57/226 |
| 3,410,076 | 11/1968 | Dyer | 57/207 |
| 3,438,186 | 4/1969 | Marshall | 57/6 |

FOREIGN PATENT DOCUMENTS 1332790 10/1973 United Kingdom .

*Primary Examiner*—John Petrakes

[57] ABSTRACT

A bouclé yarn is prepared by relaxed heat treatment of a precursor yarn prepared by combination of a low shrinkage filament or yarn or monofil at the back of the front roller of a spinning frame with a roving of high shrinkage fibers followed by twisting to a twist multiplier of 1.5 to 4.0. The shrinkage differential between the high shrinkage fibers and the low shrinkage fibers must be at least 20%.

22 Claims, No Drawings

BOUCLÉ YARN AND PROCESS FOR ITS PREPARATION

BACKGROUND OF THE INVENTION

This invention relates to improved bouclé yarns and fabrics and processes for their preparation. The bouclé yarns are prepared by combination of 2 or more components having widely different shrinkage characteristics.

Special yarns producing unusual visual and tactile effects are much in demand for the manufacture of fabrics having aesthetic properties differing from those of fabrics prepared from ordinary yarns. Such special yarns include slub or knop yarns, textured yarns and bouclé yarns. Bouclé yarns are characterized by a marked, stable loopiness on the surface of an otherwise plain yarn. The loops can vary in length and frequency and are ordinarily prepared from three or more different fiber components. The different fiber components may have different characteristics thus permitting the preparation of fabrics exhibiting the effect of differential dyeing, the effect of differences of denier, etc.

Known bouclé yarns are ordinarily prepared by combination of at least 3 fiber components. One component is overfed to form loops, a second component serves as a core onto which the loop component is twisted and a third component stabilizes the structure by tight overwrapping. This process for making these bouclé yarns is relatively slow making these yarns relatively expensive. A lower cost boucle yarn which could be prepared by a faster and simpler process would be highly desirable.

A typical process for the preparation of a bouclé yarn is disclosed in U.S. Pat. No. 3,438,186 wherein a first yarn component fed at a rate almost double that of a core yarn component is wound around the core yarn component and a third component is wound in the opposite direction around the other two yarn components.

It is known to prepare composite yarns by a core-spinning process in which a staple fiber roving is combined at the front roll of the spinning frame with a yarn that may comprise continuous filaments or staple. The two components are then twisted together. This process is used, for example, to wrap a staple roving around an elastomeric yarn to form a covered yarn. Such a product is taught by U.S. Pat. No. 1,373,880 and U.S. Pat. Nos. 2,024,155 and 2,024,156. Yarns with non-elastic core components are illustrated by U.S. Pat. No. 2,526,523, which teaches feeding of a continuous filament yarn to the front rolls of a spinning frame and wrapping it with two staple fiber rovings during twisting. Use of a high shrinkage core component to provide a bulky yarn is shown by U.S. Pat. No. 2,504,523 and U.S. Pat. No. 2,218,633.

This invention provides an improved bouclé yarn precursor yarn, an improved bouclé yarn, bouclé fabrics prepared from the bouclé yarn and an improved process for preparing the precursor yarn, bouclé yarn and bouclé fabrics. The improved yarns need only consist of two components and can be economically prepared on commercially available equipment by a simple process.

This invention provides an improved precursor yarn having a twist multiplier of 1.5 to 4.0 suitable for the preparation of a bouclé yarn comprising a core spun yarn of partially intermingled high shrinkage fibers and low shrinkage fibers twisted together, the high shrinkage fibers being predominantly on the surface of the yarn, the difference in shrinkage of the two components being at least 20% in boiling water. Preferably the high shrinkage fibers are bicomponent acrylic fibers. Most preferably the bicomponent acrylic fibers have as one component 85% by weight acrylonitrile homopolymer admixed with 15% of a 96/4 weight ratio acrylonitrile/-sodium styrenesulfonate copolymer in eccentric side-by-side relationship with the 96/4 copolymer alone as the other component.

This invention also provides a bouclé yarn prepared from the above precursor yarn comprised of stable loops of a spun or filament yarn or monofil component twisted tightly together with a straight spun yarn core, the bouclé yarn having a twist multiplier of 1.5 to 4.0 and a loop stability of 0.2 to 1.0 inches, preferably 0.2 to 0.5 inches. Preferably the straight spun yarn is comprised of bicomponent acrylic fibers. Most preferably the bicomponent acrylic fibers have as one component 85% by weight acrylonitrile homopolymer admixed with 15% of a 96/4 weight ratio acrylonitrile/sodium styrenesulfonate copolymer in eccentric side-by-side relationship with the 96/4 copolymer alone as the other component.

This invention also provides improved bouclé knit and woven fabrics.

This invention also provides a process for the preparation of a precursor yarn suitable for the preparation of a bouclé yarn wherein a component consisting of a staple fiber roving of high shrinkage fibers is fed into a spinning frame and drafted in the usual manner, a component consisting of a low shrinkage spun or filament yarn or monofil is fed into the back of the front roller of the spinning frame, combined with the drafted roving and the two components are twisted together to provide a twist multiplier of 1.5 to 4.0, the shrinkage differential of the two components in boiling water being at least 20%. Preferably the roving is comprised of high shrinkage acrylic fibers. Preferably the high shrinkage acrylic fiber roving is prepared by stretch breaking followed by processing to a roving on the worsted system. Most preferably the high shrinkage acrylic fibers are bicomponent fibers.

This invention also provides a process for preparing bouclé yarns or fabrics whereby precursor yarns or fabrics are heated sufficiently to achieve a differential shrinkage of at least 20% between the component fibers of the precursor yarn.

The precursor yarns of this invention may contain any high shrinkage staple fiber component combined with a low shrinkage filament or staple yarn or monofil component so long as the difference in shrinkage between the two components is at least 20%. Preferably, the high shrinkage fibers are acrylic fibers, most preferably bicomponent acrylic fibers. The precursor yarn is prepared from a roving of high shrinkage fibers, preferably prepared by stretch breaking on commercial stretch breaking equipment such as a Turbostapler ® or Seydel ® machine to form a sliver which is preferably drafted on the worsted system to form the roving. The roving is drafted in a spinning frame in the usual manner except that low shrinkage filament or staple yarn or monofil is combined with the drafted roving at the back of the front roller of the spinning frame followed by twisting to provide a twist multiplier of 1.5 to 4.0. The shrinkage difference between the high shrinkage and low shrinkage fiber components must be at least 20% and preferably is about 30%.

The bouclé yarn of this invention is prepared by heating relaxed precursor yarn in yarn or fabric form at a sufficiently high temperature to provide the required differential shrinkage of at least 20%. Preferably, the shrinkage is accomplished in boiling water and may conveniently occur during a dyeing step. A differential shrinkage of at least 20% provides loops in the low shrinkage component which are held tightly in place by high shrinkage fibers.

Bouclé fabrics may be prepared by processing precursor yarns into fabrics followed by a suitable relaxed heat treatment to provide a differential shrinkage of at least 20%. Alternatively, a bouclé yarn may be prepared by relaxed heat treatment of a precursor yarn and then processing the resulting bouclé yarn into a fabric. Comparable knit fabrics may be prepared by either route. Woven fabrics are best prepared from precursor yarns followed by relaxed heat treatment to form the bouclé fabric.

The high shrinkage fibers can be of any type so long as their shrinkage is suffiently high to provide a differential shrinkage of at least 20% when combined with a low shrinkage fiber. Acrylic fibers are most preferred and preferably are bicomponent acrylic fibers consisting of two components in eccentric side-by-side relationship. High shrinkage polyester fibers may also be used, e.g., fibers of a copolymer of 95% by weight poly(ethylene terephthalate) and 5% by weight poly(ethylene glutarate) or partially oriented polyester yarns obtained by spinning at 3500 to 4000 yards/minute. When stretch breaking is used, in some instances, shrinkage can be enhanced by steaming the tow before stretch breaking. Preparation of the high shrinkage roving can be conveniently carried out on the worsted system from a sliver prepared by stretch breaking but may also be prepared on other systems starting with cut staple fibers.

The low shrinkage filament or staple yarn or monofil may consist of any low shrinkage fibers which in combination with high shrinkage fibers will provide a differential shrinkage of at least 20%. Yarns may be crimped or bulked but the most striking visual effects are obtained when the low shrinkage yarns are flat, i.e., uncrimped, not bulked.

A high shrinkage roving and low shrinkage yarn may be combined on any suitable spinning equipment so long as the low shrinkage yarn is added after the roving is drafted. This is conveniently accomplished by combining the low shrinkage yarn with the drafted high shrinkage roving at the back of the front roller of a spinning frame. Twisting together a high shrinkage yarn and a low shrinkage yarn does not provide the yarn of the present invention.

Twisting in the spinning machine should be sufficient to provide a twist multiplier in the precursor yarn of 1.5 to 4.0. At the most common deniers this amounts to about 8 turn/inch.

The precursor yarn is a core spun yarn of partialy intermingled high shrinkage and low shrinkage fibers in which the high shrinkage fibers are predominately on the surface.

Knit or woven fabrics can be prepared by conventional methods either from precursor yarns or bouclé yarns. Shrinkage is accomplished by appropriate heat treatment and is most conveniently carried out in boiling water during a dyeing operation.

The high shrinkage and low shrinkage fibers may advantageously have different dyeing characteristics whereby variable coloring effects can be obtained in the resulting yarns or fabrics.

The bouclé yarns of the present invention have highly stable loops as indicated by loop stability of 0.2 to 1.0, preferably 0.2 to 0.5 inches. The length, frequency and general aesthetic effect of the loops can be varied by modification of differential shrinkage, fiber brightness, relative size of the fibers, the type of low shrinkage yarn used, dye receptivity differences etc. between the components. Other variations will occur to one skilled in the textile arts.

Tests

Total Yarn Shrinkage

The yarn to be tested, after conditioning at 21° C., 65% RH, is wound on a reel to provide a skein of convenient size. The length of the skein is determined while it is under a load of 0.002 g/den (0.0022 g/dtex). It is exposed, while relaxed, to a boiling water bath for 30 minutes, centrifuged, tumble dried, conditioned at 21° C., 65% RH and its length again determined while under the same load. Shrinkage is expressed as % of original skein length. This method also gives an accurate value for shrinkage of the high-shrinkage component when testing a composite yarn, thus making it unnecessary to prepare a yarn from the roving merely for shrinkage determination.

Twist Multiplier

Twist multiplier is equal to the twist in turns/inch divided by the square root of th spun yarn count.

Loop Stability Test

The precursor yarn is boiled-off and tumble dried at 180° F. to achieve the bouclé effect; conditioned for 24 hours at 70° F. and 50% RH prior to testing. The bouclé yarn is pre-tensioned at 80 mgs/d load. A randomly selected loop is smoothed gently to close its sides to parallel and the length of this loop is measured. A wire hook is used to pull this loop perpendicularly out of the yarn bundle under a load of 0.1 gm/denier. The length of this loop thus extended is measured. Ten loops are measured in this way. Loop stability is the difference between the averages of the ten original and ten extended loop lengths.

EXAMPLE 1

A 3 denier per filament (3.33 dtex/filament) acrylic bicomponent tow of 470,000 denier (52,000 tex) available commercially as Orlon® T-21 acrylic tow was stretch broken on a Turbo Stapler® as known in the art using a draw ratio of 1.5× at 300° F. (149° C.). The resulting sliver was processed on the worsted system through 4 passes on pin drafters, using respectively 12, 15, 18 and 18 pins/inch (4.7, 5.9, 7.1 and 7.1 pin/cm) at respective drafts of 7.0, 7.7, 7.7 and 8.6× to a finished sliver of 70 grains/yard (4960×). The sliver was drafted 11.6× to a roving weight of 2.1 hanks (428 tex). The roving was spun into yarn on a long-draft, ring-spinning frame with introduction of 2 ends of 150 denier/34 filament polyester yarn which is available commercially as Dacron® T-56 polyester fiber, to the back of the front rolls. The resulting core-spun yarn was 1/14 worsted count (1/63.2 tex) and had 7.0 Z turns/inch (2.8 Z turns/cm.). The yarn was plied with itself to 2/14 worsted count (2/63.2 tex) using 2.85 turns/inch (1.1 turns/cm) ply twist. The yarn components had a shrinkage differential of 39% (46.6% shrinkage in the high shrinkage fibers and 7.7% shrinkage in the low shrinkage fibers). The loop stability was 0.78 inches.

The plied yarn was knitted on a 7-cut flatbed knitted machine using a Jersey stitch. The fabric was piece dyed and tumble dried whereby the high-shrinkage staple-fiber component shrank forcing the filament yarn to the surface as loops to form an attractive bouclé fabric.

EXAMPLE 2

A 3 denier per filament (3.3 dtex/fil), 470,000 denier (52,000 tex) tow of acid-dyeable acrylic fiber available commercially as Orlon® type 44 acrylic fiber was stretch-broken on a Turbo-Stapler® by drawing to 1.5× at 250° F. (121° C.). The resulting sliver was converted to a 1/14 worsted count (1/63.2 tex) yarn by the process of Example 1 except that only one end of the polyester yarn was introduced at the back of the front roll of the spinning frame. The yarn components had a differential shrinkage of 27% (34.7% shrinkage in the high shrinkage component and 7.7% shrinkage in the low shrinkage component). The loop stability was 0.20 inches. When plied with itself, knitted to a Jersey fabric and finished as in Example 1, a very attractive bouclé fabric was obtained.

EXAMPLE 3

A yarn with only 17% differential shrinkage (25.0% in the high shrinkage component and 7.7% shrinkage in the low shrinkage component) was prepared by stretch breaking the tow of Example 2 1.39× at 250° F. (121° C.) and combining with 1 end of the polyester yarn substantially as in Example 2. A fabric prepared from this yarn by the method described in Example 1 did not develop the pronounced yarn loops seen in the fabric of the preceding example, presumably because of inadequate shrinkage differential between the staple-fiber component and the continuous filament yarn.

EXAMPLE 4

A. A sliver containing 2 high-shrinkage components for cross-dyeing purposes was prepared by blending a sliver prepared as described in Example 1 with another prepared as described in Example 2. This blended sliver was spun as in Example 1 but with addition at the back of the front roll of 1 end of 500 denier (555 dtex), 92 filament, acid-dyeable, trilobal, bright, bulked continuous filament nylon yarn obtainable commercially as Du Pont Nylon T-747 to a yarn count of 2/10 worsted count (2/88.5 tex) with 6.0 Z/2.5 S twist/inch (2.4 Z/1 S twist/cm). The shrinkage differential was 17% (20.8% for the nylon yarn, 38.2% with a blended staple).

B. Part A was repeated with substitution of a partially oriented, 400 denier (444 decitex), 68 filament trilobal nylon yarn commercially available as Du Pont Nylon Type 171 for the nylon used in Part A. Shrinkage differential of these components was 37% (6.5% for the nylon yarn and 43.9% for the blended sliver).

The yarn of Part A was insufficiently modified to provide an attractive bouclé yarn while the yarn of Part B could be knit into a fabric which on appropriate heat treatment provided an excellent bouclé effect.

EXAMPLE 5

This example illustrates use of a spun yarn as the low shrinkage component.

A 100% cotton roving was separately spun and plied to a 20/2 cotton count (29.6/2 tex) yarn which was introduced at the back of the front roll of a spinning frame to a high shrinkage drafted roving such as described in Example 2. The combined yarn count was 1/9 worsted count (1/98.4 tex); the yarn had 6.0 Z twist/inch (2.4 Z twist/centimeter). This yarn was plied with itself to 2/9 worsted count (2/98.4 tex) yarn with 2.5 turns/inch (1 turn/centimeter) ply twist. The shrinkage differential was 28% (6.2% for the cotton yarn and 34.2% for the high shrinkage component). When knitted into a fabric and boiled in water, the fabric had an attractive bouclé effect.

EXAMPLE 6

A yarn was prepared using the identical conditions as Example 1 except the yarn was not plied prior to knitting. The singles yarn was knitted on a 7 cut flat-bed knitting machine using a Jersey stitch and dyed and finished in a manner similar to the procedures used in preparing the fabric of Example 1. The finished fabric had surface loops and provided an attractive bouclé effect.

EXAMPLE 7

A high shrinkage fiber was prepared in a manner similar to that described in Example 1. This sliver was drafted 8.5× to a roving weight of 1.5 hanks (591 tex). The roving was spun into yarn on a long-draft, ring-spinning frame with introduction to the back of the front roll of 3 ends of 140 denier-34 filament nylon yarn which is available commercially as Du Pont Nylon T-863. The 3 ends were needed to obtain the weight percentage of loop yarn required for a readily noticeable thickness of filament yarn for contrast with the staple core. The resulting core-spun yarn was 1/10 worsted count (1/88.5 tex) and it had 4.0 twist/inch (1.7 twist/cm.). It was plied with itself to 4/10 worsted count using 1.9 S turns/inch (0.75 S turns/cm) ply twist. The differential shrinkage was 40%.

The plied yarn was skein dyed and dried relaxed at which point loops were formed. The yarn containing very large attractive loops could easily be hand-knitted.

EXAMPLE 8

A 100% rayon roving was separately spun into a 1/12 worsted count (2/74 tex) yarn and introduced at the back of the front roller of a spinning frame to a high shrinkage drafted roving such as described in Example 2. The yarn count and shrinkage differential was similar to the yarn of Example 5. When knitted and treated with boiling water, the fiber had an attractive bouclé effect.

The operative range in shrinkage differential between components in the practice of this invention is limited on the low side by the amount of shrinkage required to achieve the desired visual and tactile effect. The upper limit of differential shrinkage, although influenced by the visual and tactile effect desired, should take into account the problems in processing that can result from excessive shrinkage of the yarn. Extremely open fabric construction before dyeing can lead to processing problems, and the effects of high shrinkage on equipment capacity (narrowing of fabric, shortening of skeins etc., in boil off) may not be acceptable. The range of operative shrinkage differential can, therefore, be defined from a low, which gives the smallest desirable effect, typically about 20%, to a high which gives the largest and/or most frequent loops desired consistent with acceptable textile processing and economics.

Although for convenience the invention has been exemplified only by worsted system processing, it will be apparent that with suitable rebreaking or use of short length staple fibers, the cotton system with ring spinning also would be suitable.

Higher twist during core spinning decreases loop size.

Addition of two or more ends of yarns to the drafted roving at the back of the front roller of a textile spinning machine is equivalent to addition of a single end 2 or more times as large and thus amounts to use of two components only. Examples 2, 3 and 4 illustrate the utility of single-component addition. Example 5, although employing a doubled yarn, in effect is adding a single component.

The plying of the precursor yarn as in Examples 1, 2 and 5 before development of the bouclé effect is to obtain the desired yarn size and is not essential to development of the bouclé effect. Example 6 illustrates use of an unplied precursor yarn to make an attractive bouclé fabric.

I claim:

1. An improved precursor yarn having a twist multiplier of 1.5 to 4.0 suitable for the preparation of a bouclé yarn comprising a core spun yarn of partially intermingled high shrinkage fibers and low shinkage fibers twisted together, the high shrinkage fibers being predominately on the surface of the yarn, the difference in shrinkage of the high shrinkage and low shrinkage fibers being at least 20% in boiling water.

2. The yarn of claim 1 wherein the high shrinkage fibers are bicomponent acrylic fibers.

3. The yarn of claim 2 wherein the bicomponent acrylic fibers are comprised of one component 85% by weight acrylonitrile homopolymer admixed with 15% of a 96/4 weight ratio acrylonitrile/sodium styrene-sulfonate copolymer in eccentric side-by-side relationship with the 96/4 copolymer alone as the other component.

4. The yarn of claim 1 wherein the low shrinkage fibers are in the form of a filament yarn.

5. The yarn of claim 1 wherein the low shrinkage fibers are in the form of a spun yarn.

6. The yarn of claim 1 wherein the low shrinkage fibers are in the form of a monofilament.

7. A bouclé yarn prepared by shrinkage of the yarn of claim 1 comprised of stable loops of a spun or filament yarn or monofil component twisted tightly together with a straight spun yarn core, the bouclé yarn having a twist multiplier of 1.5 to 4.0 and a loop stability of 0.2 to 1.0 inches.

8. The yarn of claim 7 wherein the straight spun yarn is comprised of bicomponent acrylic fibers.

9. The yarn of claim 8 wherein the bicomponent acrylic fibers consist of one component 85% by weight acrylonitrile homopolymer admixed with 15% of a 96/4 weight ratio acrylonitrile/sodium styrene-sulfonate copolymer in eccentric side-by-side relationship with the 96/4 copolymer alone as the other component.

10. The yarn of claim 7 wherein the looped yarn component is a filament yarn.

11. The yarn of claim 7 wherein the looped yarn component is a spun yarn.

12. The yarn of claim 7 wherein the looped yarn component is a monofilament.

13. Knit fabrics containing the yarn of claim 7.

14. Woven fabrics containing the yarn of claim 7.

15. Process for preparing a bouclé fabric wherein the fabric of claim 13 or 14 is heated without restraint.

16. Process for the preparation of a bouclé fabric wherein the fabric of claim 13 or 14 is heated without restraint in boiling water.

17. Process for preparing the precursor yarn of claim 1 wherein a component consisting of a staple fiber roving of high shrinkage fibers is fed into a spinning frame and drafted in the usual manner, a component consisting of a low shrinkage spun or filament yarn or monofilament is fed into the back of the front roller of the spinning frame and combined with the drafted roving and the two components are twisted together to provide a twist multiplier of 1.5 to 4.0, the shrinkage differential of the two components in boiling water being at least 20%.

18. The process of claim 17 wherein the staple fiber roving is comprised of high shrinkage acrylic fibers.

19. The process of claim 18 wherein the high shrinkage acrylic fiber roving is prepared by stretch breaking followed by processing to a roving on the worsted system.

20. The process of claim 18 wherein the acrylic fibers are bicomponent fibers having as one component 85% by weight acrylonitrile homopolymer admixed with 15% of a 96/4 weight ratio acrylonitrile/sodium styrene-sulfonate copolymer in eccentric side-by-side relationship with the 96/4 copolymer alone as the other component.

21. Process for preparing a bouclé yarn whereby the yarn of claim 1 is heated relaxed.

22. Process of claim 21 wherein the yarn is heated in boiling water.

* * * * *